US009705265B2

(12) United States Patent
Lowder

(10) Patent No.: US 9,705,265 B2
(45) Date of Patent: Jul. 11, 2017

(54) CONFIGURABLE ELECTRICAL CONNECTOR KEY FOR ELECTRONIC DOOR LOCKS

(71) Applicant: Sargent Manufacturing Company, New Haven, CT (US)

(72) Inventor: Scott B. Lowder, Orange, CT (US)

(73) Assignee: SARGENT MANUFACTURING COMPANY, New Haven, CT (US)

( * ) Notice: Subject to any disclaimer, the term of this patent is extended or adjusted under 35 U.S.C. 154(b) by 37 days.

(21) Appl. No.: 14/774,396

(22) PCT Filed: Mar. 14, 2014

(86) PCT No.: PCT/US2014/027109
§ 371 (c)(1),
(2) Date: Sep. 10, 2015

(87) PCT Pub. No.: WO2014/152240
PCT Pub. Date: Sep. 25, 2014

(65) Prior Publication Data

US 2016/0043516 A1 Feb. 11, 2016

Related U.S. Application Data

(60) Provisional application No. 61/791,975, filed on Mar. 15, 2013.

(51) Int. Cl.
*H01R 24/28* (2011.01)
*H01R 13/46* (2006.01)
(Continued)

(52) U.S. Cl.
CPC ..... *H01R 24/28* (2013.01); *E05B 17/22* (2013.01); *E05B 47/0012* (2013.01);
(Continued)

(58) Field of Classification Search
CPC ..... H01L 2924/12041; H01L 2924/00; H01L 24/18; H01L 25/0753; H01L 27/156;
(Continued)

(56) References Cited

U.S. PATENT DOCUMENTS 5,005,393 A 4/1991 Ewalds et al.
5,701,828 A * 12/1997 Benore ..... E05B 47/0002 109/53
(Continued)

FOREIGN PATENT DOCUMENTS

DE 202006004553 U1 6/2006
WO 2006084271 A2 8/2006
WO 2008020946 A1 2/2008

*Primary Examiner* — Yong Hang Jiang
(74) *Attorney, Agent, or Firm* — DeLio, Peterson & Curcio, LLC; Peter W. Peterson

(57) ABSTRACT

A configurable electrical connector key for connecting an electronic door lock to an external unit, such as a lock monitoring or control system, includes a connector key housing shaped to engage the electronic door lock and a configurable circuit mounted within the connector key housing that makes a configured interconnection between selected components within the door lock and the external unit. The combination of an electrical connector key and an electronic door lock and a system and method including multiple differently configured electrical connector keys and one or more standardized electronic door locks allow selected sensors and functions of the door lock to be enabled by selecting an appropriately configured electrical connector key.

22 Claims, 6 Drawing Sheets

(51) Int. Cl.

| | |
|---|---|
| ***H01R 13/66*** | (2006.01) |
| ***H01R 43/26*** | (2006.01) |
| ***H01R 43/02*** | (2006.01) |
| ***E05B 17/22*** | (2006.01) |
| ***E05B 47/00*** | (2006.01) |
| ***E05B 47/06*** | (2006.01) |

(52) U.S. Cl.
CPC ..... *E05B 47/0673* (2013.01); *H01R 13/465* (2013.01); *H01R 13/6683* (2013.01); *H01R 43/02* (2013.01); *H01R 43/26* (2013.01); *E05B 2047/0031* (2013.01); *E05B 2047/0048* (2013.01); *E05B 2047/0067* (2013.01)

(58) Field of Classification Search
CPC ..... H01L 2924/15788; H01L 2933/005; H01L 33/54; H01L 33/56; H01L 33/62; E05B 17/22; E05B 2047/0031; E05B 2047/0048
See application file for complete search history.

(56) References Cited

U.S. PATENT DOCUMENTS

| | | | | |
|---|---|---|---|---|
| 6,431,894 | B1 | 8/2002 | Boiret et al. | |
| 2010/0087106 | A1* | 4/2010 | Lawson ..... | H01R 11/12 439/884 |
| 2011/0203331 | A1 | 8/2011 | Picard et al. | |
| 2011/0252843 | A1 | 10/2011 | Sumcad et al. | |
| 2012/0040563 | A1 | 2/2012 | Wang et al. | |
| 2012/0186312 | A1 | 7/2012 | Lowder et al. | |
| 2013/0061644 | A1 | 3/2013 | Trent et al. | |
| 2013/0298616 | A1 | 11/2013 | Ullrich et al. | |
| 2013/0298619 | A1 | 11/2013 | Ullrich et al. | |
| 2014/0073148 | A1* | 3/2014 | Gallerand ..... | H01R 12/7029 439/76.1 |

* cited by examiner

CONFIGURABLE ELECTRICAL CONNECTOR KEY FOR ELECTRONIC DOOR LOCKS

BACKGROUND OF THE INVENTION

1. Field of the Invention

The present invention relates to devices for making electrical connections to electrical components within electronic door locks. More specifically, the present invention relates to a shaped electrical connector that keys into an electronic door lock and can be configured during manufacture to carry electrical signals to and/or from selected electrical sensors, actuators and/or other components within the lock. By selecting a particularly configured electrical connector key the electrical components available for use within the door lock are also selected.

2. Description of Related Art

Modern electronic door locks may be provided with a wide variety of electronic components, such as sensors, actuators and other electronic components. The components may include actuators, such as motors, solenoids, linear drivers and the like that operate electrically and allow the lock to be remotely locked or unlocked. The electronic door lock will also typically include one or more sensors positioned within the lock to detect and signal the position of various lock components, such as the latchbolt, the deadbolt, the locked or unlocked status of the lock, the position of the door relative to the door frame (door open or closed), and the like. The electronic door lock may also be provided with other kinds of auxiliary electronic components, such as microcontrollers and memory, and the like.

For many electronic door lock designs, the electronic components within the lock are electrically connected to an external unit located outside the lock, such as a door lock control system, a building security system, an emergency fire control system or monitoring system, and the like. The connection from the lock to the external unit is typically made with wires that connect through a wiring harness to the external unit.

When an electronic door lock is ordered, the customer may specify many different configurations, with different actuators and sensors. Each different configuration must be assembled at the factory and must be provided with a matching wiring harness to allow connection of each of the specified components—sensors, actuators, and the like—to the external unit.

The multiple different configurations make it difficult and expensive to retain all the differently configured locks in stock. Often, each different configuration must be assembled individually and a matching wiring harness must be prepared and connected to the internal electronic lock components by hand.

Problems arise in making multiple connections between the electronic door lock components and an external unit. Such problems also encompass the connectors, the wiring harness and the selection of sensors within the lock that are to be made available to the external unit.

The sensors may be contact switches, magnetically operated reed switches, Hall effect sensors and/or other types of sensors. Usually, such sensors are located to signal the position of mechanical components within the lock and/or the door. The sensors may be used to indicate whether the door lock is in the locked or unlocked state. They may indicate if the latchbolt is extended or retracted, or whether the door on which the lock is installed is open or closed.

They may monitor the position of a deadbolt, the rotation of a handle or signal whether the lock has performed other functions.

In addition to the sensors, there may be different actuators within the electronic lock. The actuator may be a motor, a linear driver, a solenoid, a solenoid emulator in the form of a stepping motor or stepping motor integrated into a linear actuator, and the like. Again, many different actuators are available for different applications and different customers.

The most common types of actuators are 12 volt or 24 volt solenoids that may be ordered as "fail safe" (if power is lost the door defaults to unlocked) or "fail secure" (defaults to locked). The solenoid designs are typically intended for use with centralized building control systems where the external unit is centrally located and is connected to multiple electronic locks with wires. The external unit sends a simple on or off power signal to lock or unlock each electronic lock by switching it away from its default state when power is applied. When power is removed, the lock returns to its default state.

In the "solenoid" type design actual solenoids may be used, or solenoid emulation may be used in which a motor, linear driver or other actuator responds to the same type of simple "on power" vs. "off power" control signal.

When the electronic lock is a motorized design, it is most commonly used with an external unit mounted on or immediately adjacent to the door. Typical applications for this type of low power motor actuator electronic lock include hotels, secure buildings and the like where a card key reader, secure proximity detector, keypad, biometric (fingerprint, iris scan, voice recognition, and the like) is located in the external unit. The external unit may also include batteries to provide power through wired connections to the electronic lock.

The external unit for this type of lock may be located in one or more additional housings mounted on the door. Wires extend from the sensors in the lock to the external unit to provide information to the external unit about the status of the lock. Wires may also carry control signals from the external unit to actuators in the electronic lock to lock or unlock the door in response to the presentation of security credentials.

There are many other potential electronic door locks that it may be desirable to offer for sale, and each may be provided with a wide variety of available sensors to meet various needs. Wiring for all of these different components actuators and sensors must exit the lock housing, regardless of whether the external unit is mounted in close proximity to the lock, as is common for motorized and battery powered locks, or in a more distant central location as is typical for solenoid locks.

The numerous possible variations in lock configuration results in many different wiring harnesses and typically requires each of the sensors to be manually installed and connected. This is labor intensive and expensive as well as making it difficult to keep the many variations in stock for rapid delivery to customers.

In view of the above, there is a need for an improved wiring harness and connection system that reduces the manual interconnection and wiring required for electronic locks having different sensors and actuators.

SUMMARY OF THE INVENTION

The present invention addresses the problem of making multiple connections between the electronic door lock components and an external unit. It also relates to connectors, the wiring harness and the selection of sensors within the lock that are to be made available to the external unit.

The electronic lock of this invention may be a mortise lock and a mortise lock will be used herein to describe an exemplary implementation of this invention. However, the lock may also be a bored lock or any other type of conventional lock mechanism. The "electronic lock" as referred to herein contains one or more mechanical locking components which may be a latchbolt, a dead bolt, a guard bolt, handles for retracting the latchbolt (or lock components connected to such handles), knobs or levers for extending/retracting the deadbolt, buttons or turn knobs for manually locking/unlocking the electronic lock, key cylinders and the like.

The present invention is designed for lock devices, such as mortise locks, that incorporate multiple electronic components, such as magnetic sensors to sense the positions of moving components in the lock, such as the latch bolt, the deadbolt and the like. In an exemplary application for this invention, a mechanical lock is electrified by adding small magnets to moving mechanical components within the lock and by adding magnetically operated reed switches or Hall effect sensors to a primary circuit board mounted within a recess in the mortise lock cover.

The sensors may be mounted to the primary circuit board such that they protrude into close proximity with the corresponding magnet for the component being monitored when the mortise lock cover is installed. The primary circuit board may connect to one or more secondary circuit boards, such as controller boards for motors or solenoids or solenoid emulating drive systems, and the like.

It will be understood that not all customers want the same type of sensors installed and that locks that are mechanically quite similar may be quite different electrically due to the use of different sensors, different drive systems that remotely lock and unlock the lock mechanism, and the like. The number of wires that must exit the lock mechanism may vary widely and the connector on the end of those wires will vary widely.

For example, one type of connector may be used for a motorized drive system in the lock that must be connected to a particular type of control system that drives a motorized lock. Another type of connector may be used for solenoid type locks to be driven by a controller for solenoid type locks. Further, each type of drive system is typically offered with a wide variety of different optional lock sensors. It is quite expensive to produce and stock all the different electrical variations of each mechanical lock mechanism.

Bearing in mind the problems and deficiencies of the prior art, it is therefore an object of the present invention to provide an electronic lock that separates the lock mechanism from the external wiring harness and connects the two together with a connector in the form of a configurable electronic key that has the specialized connector for the lock control system on one end and the electronic key on the other end.

It is another object of the present invention to provide an electronic lock that includes an electronic key that plugs into an opening in the back of the mortise lock to enable various sensors already located within the lock mechanism.

The above and other objects, which will be apparent to those skilled in the art, are achieved in the present invention which is directed to an electrical connector key for electrically connecting selected components mounted within an electronic door lock to an external unit having a connector key housing shaped to engage the electronic door lock, a lock side key connector mounted to the connector key housing for electrically connecting to the electronic door lock. The lock side key connector includes a plurality of electrical connection points, and the lock side key connector is shaped to electrically connect to a mating lock connector mounted within the electronic door lock when the connector key housing engages the electronic door lock. The electrical connector key includes a plurality of external electrical outputs for connection to the external unit and a configurable circuit is mounted within the connector key housing. The configurable circuit includes a plurality of electrical connections extending from a selected set of the electrical connection points on the lock side key connector to a selected set of the external electrical outputs, and the plurality of electrical connections of the configurable circuit and the selected sets of the electrical connection points and the external electrical outputs define a configured interconnection between the selected components within the electronic door lock and the external unit.

The electrical connector key housing may be shaped to snap into a mating opening in the electronic door lock. The plurality of external electrical outputs for connection to the external unit may comprise a plurality of wires and selected wires are soldered at one end to the configurable circuit to define the selected set of the external electrical outputs.

The electrical connector key may communicate with the electronic door lock to identify the electrical connector key as an authorized electrical connector key.

Another aspect of the invention is the combination of an electrical connector key as described above with an electronic door lock for connecting the electronic door lock to an external unit. The electronic door lock includes a plurality of electrical components mounted therein and a lock connector for receiving the electrical connector key and connecting at least some of the plurality of electrical components to the electrical connector key. The electrical connector key includes a connector key housing shaped to engage the electronic door lock and a lock side key connector mounted to the connector key housing for electrically connecting to the lock connector of the electronic door lock. The lock side key connector includes a plurality of electrical connection points, and electrically connects and mates to the lock when the connector key housing engages the electronic door lock.

A further aspect of the invention resides in an electronic door lock system including a plurality of differently configured electrical connector keys and one or more different electronic door locks. Each door lock is capable of receiving a selected one of the differently configured electrical connector keys.

In a further aspect of the invention there is provided a method of providing an electronic door lock having desired lock functions. The electronic door lock provides the functions to an external unit. The method includes providing a plurality of differently configured electrical connector keys as described above, and providing one or more different electronic door locks. Each door lock is capable of receiving a selected one of the differently configured electrical connector keys. At least one of the one or more different electronic door locks has electronic components for performing at least all of the desired lock functions. The method includes selecting only one of the one or more different electronic door locks having electronic components for performing at least all of the desired lock functions. The method further includes selecting only one electrical connector key from among the plurality of differently configured electrical connector keys. The selected electrical connector key connects to the electronic components of the selected door lock for performing the desired lock functions and connecting to the external unit to provide the desired lock functions.

DESCRIPTION OF THE PREFERRED EMBODIMENT(S)

In describing the preferred embodiment of the present invention, reference will be made herein to FIGS. 1-8 of the drawings in which like numerals refer to like features of the invention.

Figure 1:
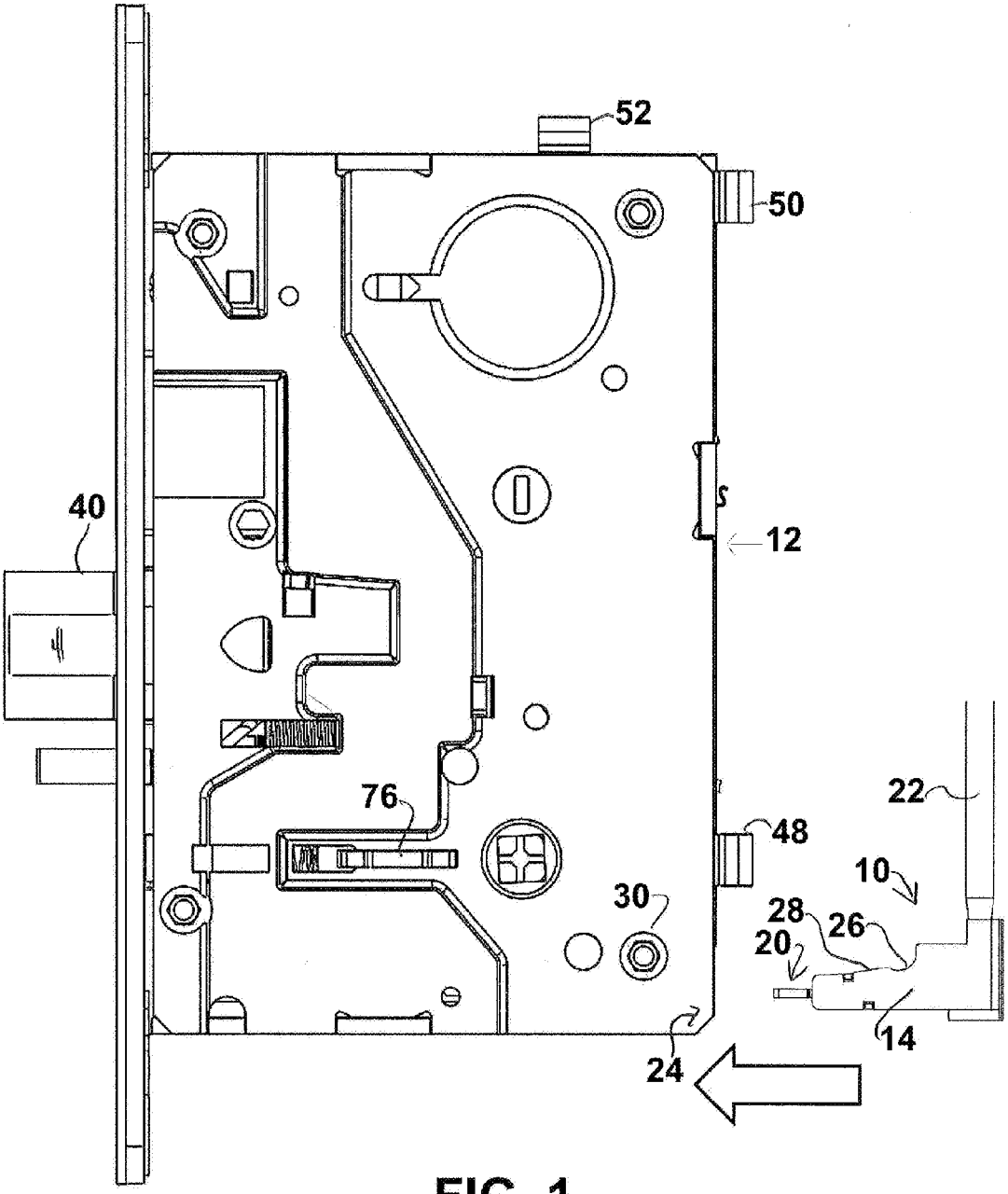
FIG. 1 is a left side elevational view of the electrical connector key of the present invention ready for connection to a mortise lock in the direction of the arrow.

Referring to FIG. 1, an electrical connector key 10 according to the present invention is provided to make connection to selected electrical components mounted within an electronic door lock 12. The electrical connector key 10 includes a connector key housing shaped to engage the electronic door lock 12.

The connector key housing is preferably formed in two halves 14, 16 (see FIG. 7) that surround a configurable circuit 18. In the embodiment shown, one end of the configurable circuit 18 is a card edge connector forming a lock side key connector 20. Within the connector key housing 14, 16, the configurable circuit 18 makes connection between connection points along the card edge connector and wires forming cable 22.

Cable 22 leads to the external unit which sends and/or receives signals passing between electrical components in the electronic door lock 12 and the external unit.

Figure 2:
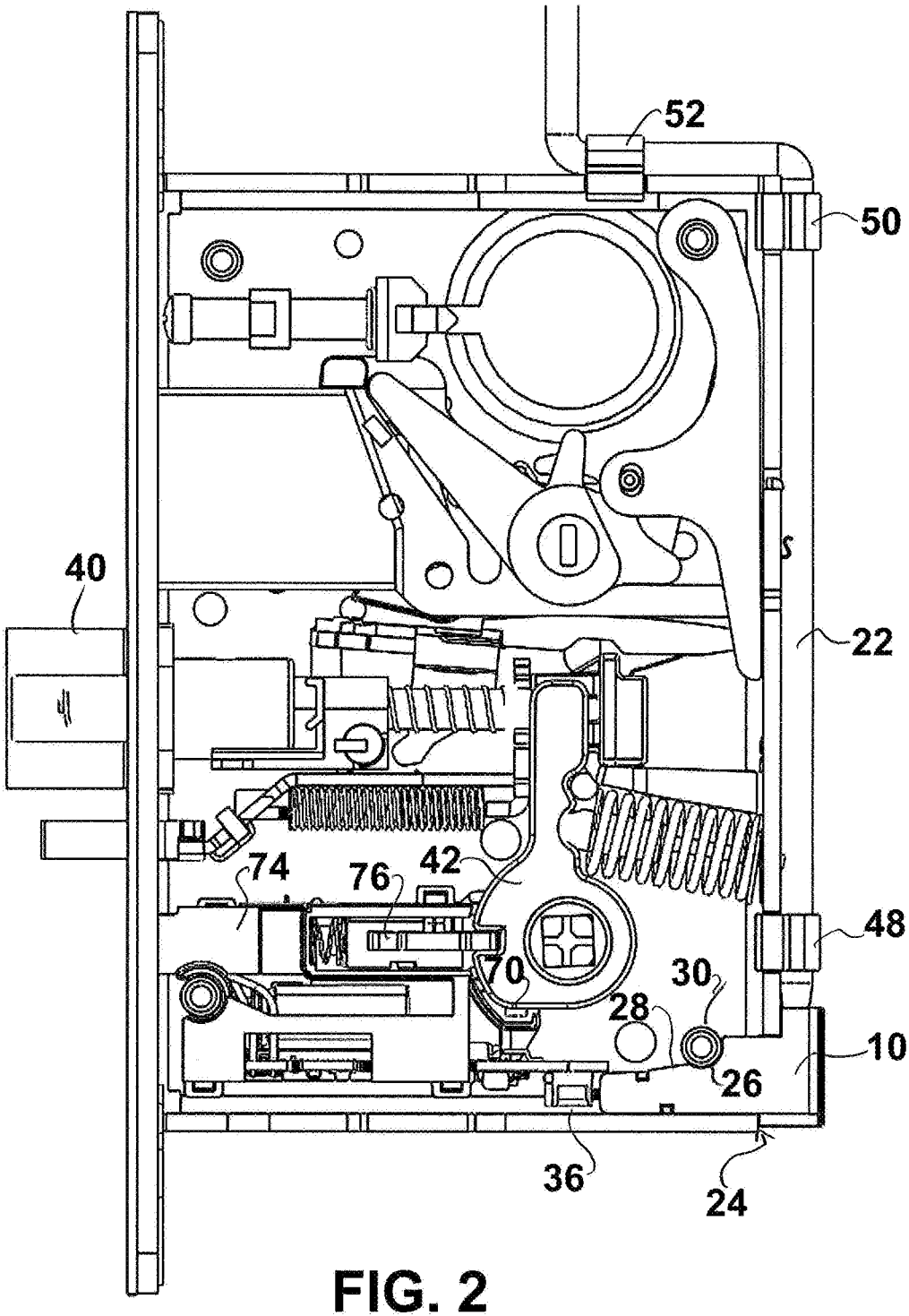
FIG. 2 is a left side elevational view of the electrical connector key of the present invention inserted into the mortise lock shown in FIG. 1. The cover plate of the mortise lock has been removed to show internal lock components, sensors and actuators and to better show how the electrical connector key of the present invention engages the mortise lock.

FIG. 2 shows the electrical connector key 10 inserted into a corresponding opening 24 in the lower right corner of the mortise lock 12. The connector key housing 14, 16 is provided with a notch or groove 26 and a ramp surface 28. As the electrical connector key 10 is inserted into opening 24, the ramp surface 28 contacts and slides under a stud 30 in the interior of the mortise lock 12. The electrical connector key 10 snaps into a desired position as the groove 26 reaches the stud 30.

Also as the electrical connector key 10 is inserted, the card edge connector forming lock side key connector 20 engages lock connector 36. This connects the circuit board 18 of the connector key 10 to electrical components within the mortise lock 12. By configuring the electrical connections provided on the configurable circuit board 18, different wires within cable 22 may be connected or not connected.

Figure 7:
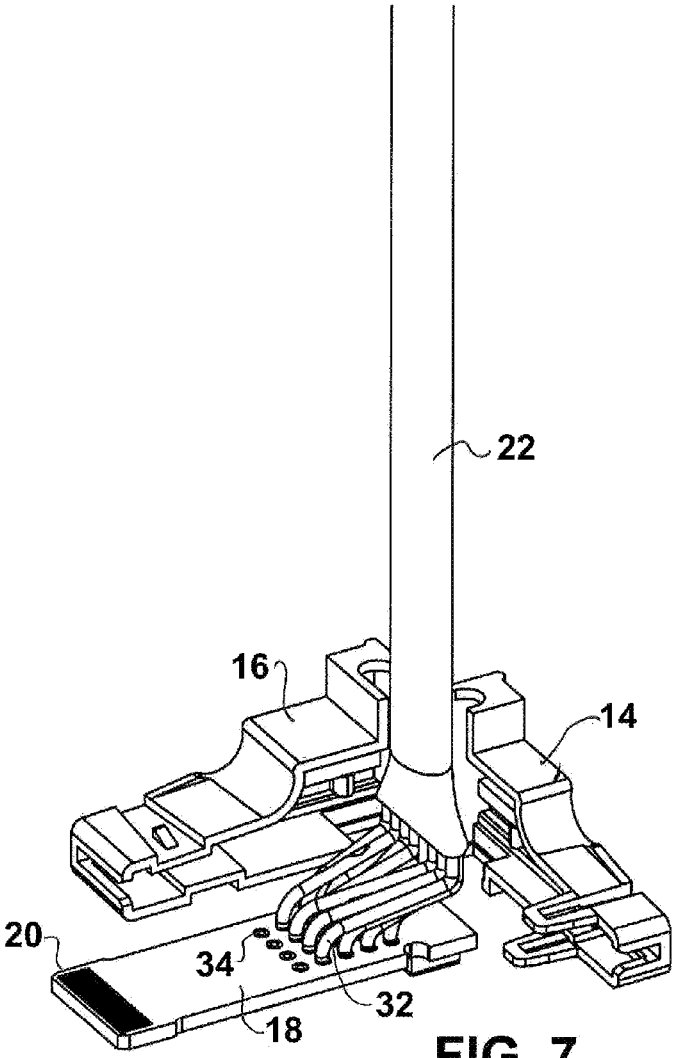
FIG. 7 is an exploded perspective view of the electrical connector key in FIG. 6.
Figure 8:
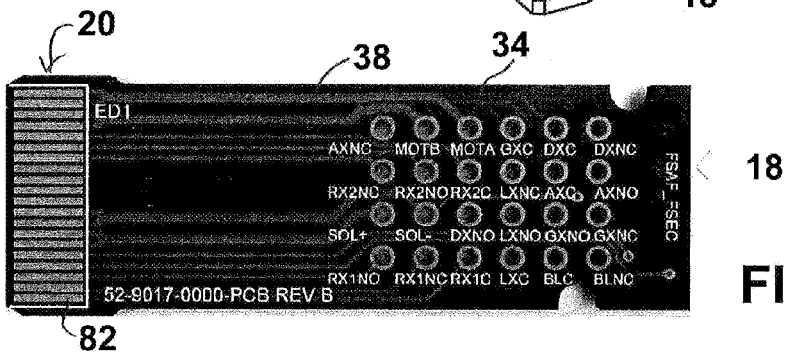
FIG. 8 is a plan view showing the configurable circuit mounted within the connector key housing. Different circuit boards may be used to achieve different desired connections or wires may be selectively connected to enable desired interconnections.

Referring to FIGS. 7 and 8, configuration of the key may be achieved simply by connecting or not connecting wires 30 in cable 22 to corresponding solder points 34 on key circuit board 18. Alternatively, circuit board traces 38 on the key circuit board 18 may be omitted or added to achieve configuration. Further, the key circuit board 18 may be provided with various cross connections, or with additional electrical components to achieve configuration.

Additional electronic components may be mounted on the key circuit board 18 to identify to circuitry in the lock and or the external unit what type of electrical connector key has been installed and or to signal that a valid and authorized electrical connector key has been installed.

Such additional components may be as simple as one or more resistors providing a resistance that may be detected by electronic circuitry in the lock (and/or the external unit) or as complex as an identification chip that provides encrypted communication with the lock to identify that an authorized electrical connector key has been installed.

It will be understood from the above description that the electrical connector key described permits a single lock mechanism 12, having multiple sensors and/or actuators to be prepared in advance and to subsequently be modified to supply different functions simply by inserting a different electrical connector key 10 into the opening 24 in the lock 12.

For example, the lock 12 may be provided with many more sensors than are typically ordered by a customer. One customer may desire no sensors on the lock and may only require a basic 12 volt fail-safe type solenoid lock. In such a lock, when 12 volt power applied is to a wire pair in cable 22, the lock will enter the locked state. When power is removed from that wire pair, the lock will revert to its default open and unlocked state. This can be achieved by not connecting any sensor wires 30 through the configurable circuit 18.

A second customer may specify a similar 12 volt fail-safe type solenoid lock except that the lock must monitor and signal the status of the maximum number of components within the lock. Components to be monitored will include the position of the latchbolt 40 (see FIGS. 1, 2 and 5), the locked or unlocked state of the lock mechanism, etc. This can be achieved by connecting all wires within cable 22 to corresponding connection points on the configurable circuit 18. The second customer is provided with a lock mechanism 12 that is identical in all respects to the lock provided to the first customer. Only the electrical connector key 10 provided to the second customer will be different.

It will be understood that the first customer will be provided with a lock mechanism having more sensors than necessary to provide the functions ordered. This increases the cost of the lock provided. However, that cost is offset by the reduction in the number of different locks necessary to be stored in inventory and by the advantages derived by rapidly shipping each customer's order due to avoiding the time and cost of custom building each different order.

Other advantages lie in the decreased cost of each lock due to the increase in the number of identical locks manufactured. The construction of the locks may be more easily automated.

Yet another advantage is derived from the fact that the lock mechanism provided to the first customer (without monitoring capability) may be upgraded in the field to a more sophisticated lock mechanism simply by removing the electrical connector key 10 initially provided and replacing it with an electrical connector key having greater monitoring capability.

In some implementations of the system described above, it may be desirable for the lock manufacturer to prepare a limited number of standard lock mechanisms of increasing complexity instead of supplying a single identical lock design to all customers with all possible sensors installed. This reduces the cost of providing the least commonly needed sensors to all customers, when there is little likelihood that such sensors will ever be used or activated by purchasing a correspondingly configured electrical connector key.

Although this requires storing more than one type of lock in inventory, it still allows a reduction in inventory and manufacturing costs as compared to holding in inventory all possible configurations for the lock. Only a small subset of locks must be manufactured—for example, a low end model having the most commonly ordered sensors, a high end model having all or almost all available sensors and one or more intermediate models having some, but not all available sensors.

The least complex and least expensive lock mechanism 12 can be selected from among the limited subset of standard locks, provided the selected lock includes all the monitoring and/or control) functions ordered by a customer. The configured electrical connector key 10 having only the ordered features will be provided with the selected lock, and total cost is reduced while still meeting the customer's needs.

In view of the modular design shown here, it is also possible to store only a limited subset of circuit boards containing various combinations of sensors and to quickly install the appropriate circuit board having all sensors required, and to match the same with an appropriately configured electrical connector key 10 that activates only those sensors actually ordered by the customer.

In the exemplary design, the electrical connector key 10 will be configured at the factory to provide all the different available combinations of functions that may be ordered. Preferably, the housing 14, 16 is permanently glued together or formed as a single molded housing. Only the less expensive, differently configured, electrical connector keys need to be stored in inventory to provide all the myriad of combinations of functions that are offered to the public.

Just prior to shipment of a lock ordered with a specified combination of functions, the appropriately configured electrical connector key 10 is selected and installed in the lock 12. The key 10 is inserted into opening 24 in the lock. The key snaps into place engaging stud 30 in groove 26 of the key.

As the key is inserted, the card edge connector 20 at one end of the configurable circuit 18 (see FIG. 7) engages the lock connector 36 in the lock 12 (see FIG. 2) and connects the wires 32 in connector cable 22 to the electronic circuitry 44 (see FIG. 3) and 46 (see FIG. 4) within the lock. This enables the specified monitoring and/or control functions. The cable 22 is then clipped into cable clips 48, 50 and 52 along the back of the lock 12.

The card edge connector 20 forming the lock side key connector includes multiple electrical connection points in the form of an array of spaced lands 82 contacted by corresponding connection points in the lock connector 36.

The cable clips 48, 50 and 52 ensure that the cable 22 is held within the mortise provided for the mortise lock 12. The connector key 10 is also shaped so that when the connector key 10 is installed, the key does not project beyond the space provided in the mortise for the mortise lock 12.

The end of the cable 22 has not been shown, but will preferably be provided with a connector suitable for connection to the external unit receiving sensor signals and or sending control signals to the actuator circuit 46 to lock or unlock the lock 12. Alternatively, the wires within cable 22 may be directly soldered to the external unit.

Figure 3:
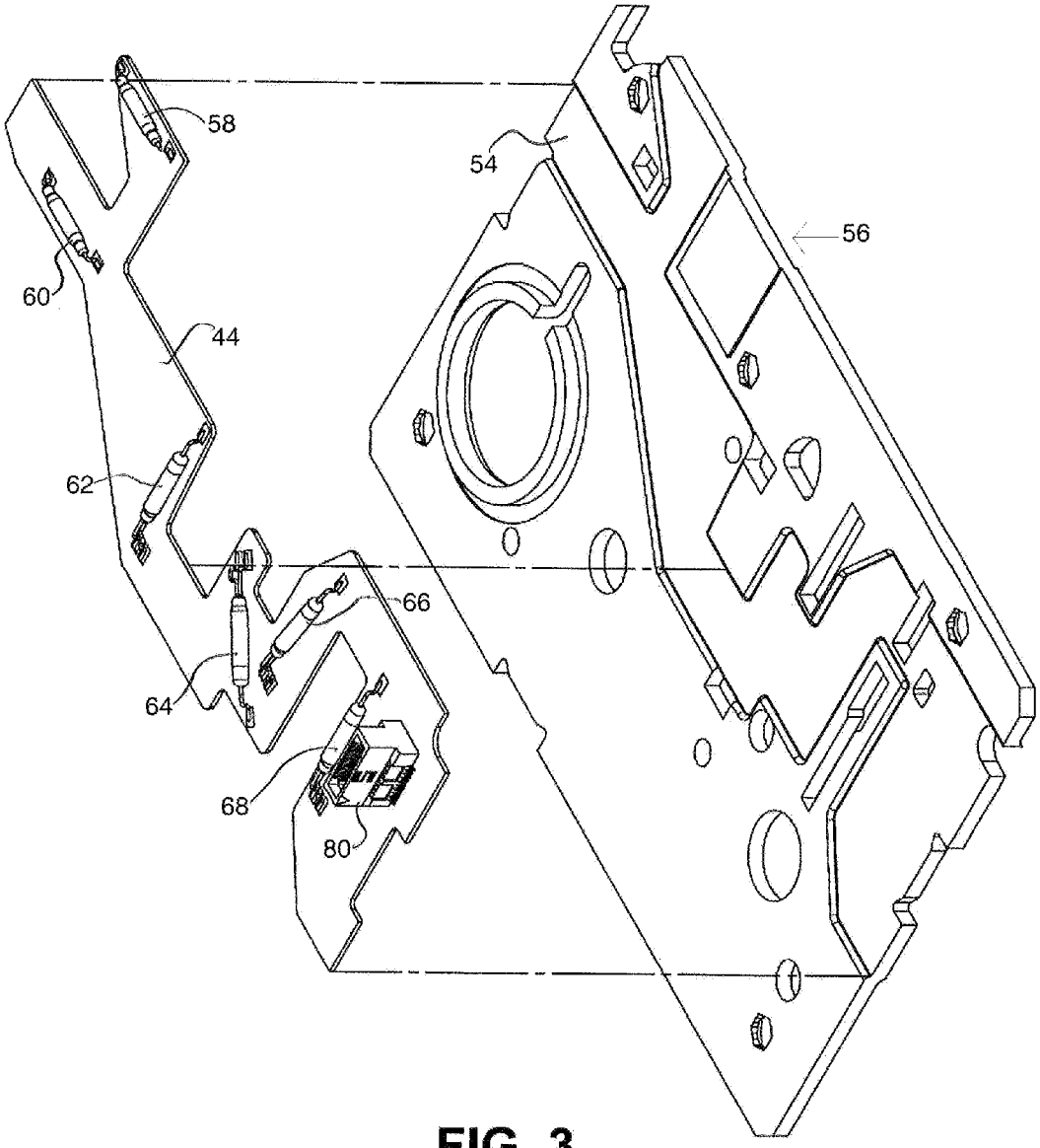
FIG. 3 is a perspective exploded view showing the mortise lock cover plate omitted from FIG. 2 and an example circuit board carrying sensors for electrical connection through the electrical connector key of the present invention.

Referring to FIG. 3, the preferred construction for the circuitry within the mortise lock is shown. The circuitry shown is an embedded circuit board 44 that fits within a corresponding recess 54 formed in the cover plate 56 for the mortise lock. The preferred design for such an embedded circuit is more fully disclosed in U.S. Pat. No. 8,325,039, the disclosure of which is incorporated herein by reference.

By embedding the circuit board in the cover plate 56, electrical connections can extend throughout the mortise lock without interfering with the mechanical components therein. Embedded circuit board 44 is provided with multiple sensors 58, 60, 62, 64, 66 and 68. In the embodiment shown, these sensors are reed switches that are actuated when a permanent magnet mounted within a nearby moving mechanical lock components moves towards and away from the sensor.

Although reed switch sensors are shown, other sensors, such as mechanical switches, Hall effect sensors and the like may also be used. Each moving lock component to be monitored is provided with a magnet to actuate the associated magnetic reed switch sensor monitoring that component. For example, magnet 70 (see FIG. 2) is mounted on spindle hub 42 and moves whenever an associated handle is rotated to retract the latchbolt 40.

Figure 4:
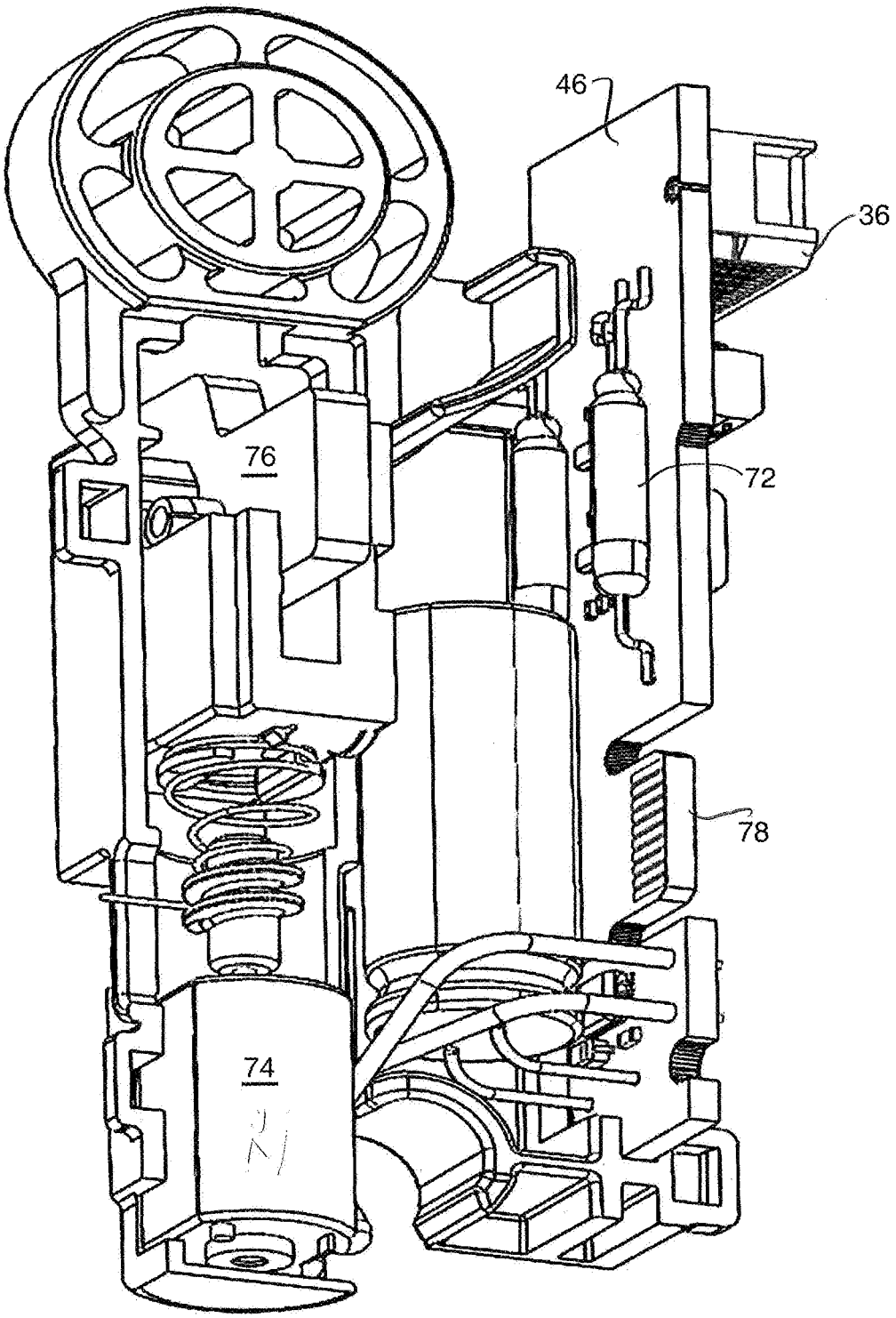
FIG. 4 is a perspective view of a motor actuator for the mortise lock in FIG. 2, which may also be connected through the electrical connector key of the present invention. Additional sensors are also seen on the circuitry associated with the motor actuator. The motor actuator shown may simulate the operation of a solenoid actuator.
Figure 5:
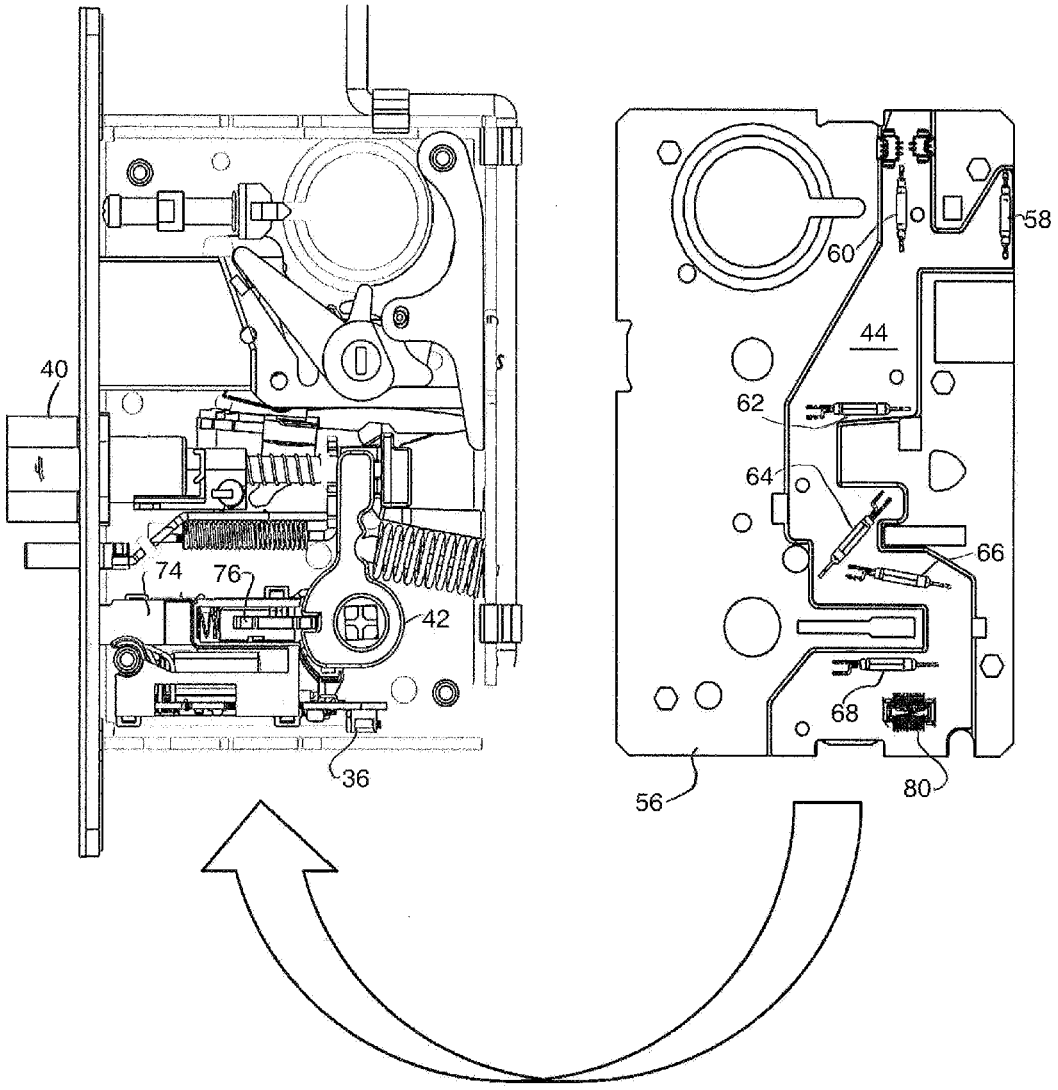
FIG. 5 is a side elevational view showing the mortise lock in FIG. 2 with the cover plate of FIG. 3. The cover plate is ready for assembly to the mortise lock in the direction of the arrow to position the sensors mounted to the circuit board of the cover plate in proper relation to the components in the mortise lock.
Figure 6:
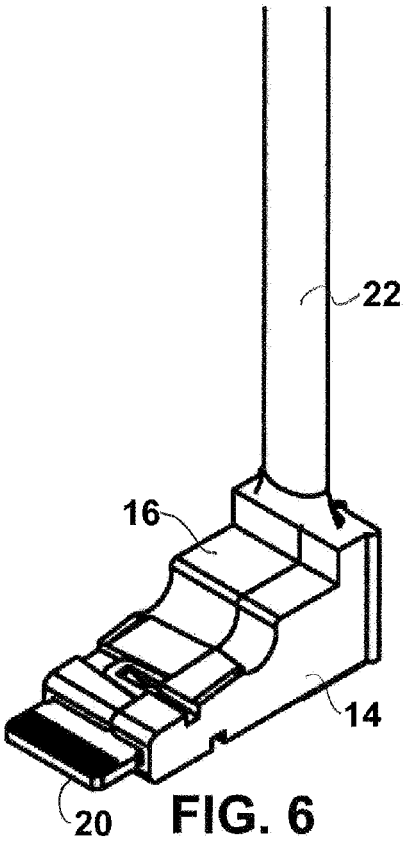
FIG. 6 is a perspective view of the electrical connector key of the present invention. Wires exiting the electrical connector key may be connected directly to the external unit or may be attached to an intervening electrical connector.

As may be seen in FIG. 5, sensors 58 and 60 are single throw magnetic reed switch sensors and have only two electrical switch connections, while sensors 62, 64, 66 and 68 are double throw switch sensors and have three electrical switch connections. Additional sensors may be provided, such as sensor 72 mounted on actuator circuit board 46 (see FIG. 4).

In the embodiment shown, the lock side key connector 20 is a card edge connector that engages connector 36 mounted on circuit board 44 for the actuator. The actuator includes control circuitry and a motor 74 that drives a locking piece 76 to lock and unlock the lock mechanism 12.

The actuator circuit board 44 includes a connector 78, which is also preferably a card edge connector, engages connector 80 on embedded circuit board 44 when the cover plate 56 is installed. In this way, the two circuit boards 44 and 46 are connected to each other and the connector 36 is positioned to receive the lock side key connector 20 when the electrical connector key 10 is inserted into the lock 12.

The sensors may be of any desired type and may be mounted on either of the disclosed circuit boards or on additional circuit boards within the lock mechanism 10.

The actuator assembly shown in FIG. 4 emulates solenoid operation using an energy efficient motor 74. The associated circuitry is operable with both 12 volts and 24 volts and is preferably switch selectable to emulate either "fail safe" (default unlocked) or "fail secure" (default locked). The actuator and associated circuitry may be of any type known to those of skill in the art. By selecting the appropriate actuator and control circuitry, the lock can be operated by and/or connected to any type of external unit to provide lock control and door lock monitoring.

Although any type of actuator and circuitry may be used, additional information about the solenoid emulator shown in FIG. 4 can be found in U.S. Provisional Patent Application Ser. No. 61/683,455 filed on Aug. 15, 2012, the disclosure of which is incorporated herein by reference.

Those of skill in this art will note that the cost of manufacturing the different configurations for the electrical connector key is relatively low as compared to the cost of constructing the lock mechanism and its sensors. It is desirable to be able to sell a low end lock mechanism with few sensors at a lower price than a higher end lock mechanism having many more sensors.

As such, it may be desirable for the manufacturer to ensure that any electrical connector key inserted into the lock is an authorized electrical connector key in order to prevent low end devices from being ordered at a low price and upgraded at low expense with an unauthorized electrical connector key that has been reconfigured to activate all sensors installed in the lock mechanism.

As previously noted, this can be achieved by placing circuitry in the electrical connector key, such as an identification chip that provides encrypted communication with a microprocessor or other digital component in the lock to identify to the lock or to the external unit that an authorized electrical connector key has been installed.

For example, a simple 3 pin device such as an Atmel AT88SA10HS-TSU-T needing only power ground and a serial data connection can be installed on the key circuit board 18 to provide digital confirmation to the lock that the installed electrical connector key is authorized. Other simpler methods of providing such confirmation of an authorized electrical connector key are also known to the art.

When complex digital encryption and handshaking techniques are used, they may require a short time period during which calculations are made to provide the necessary digital confirmation of authorized status. If the electrical connector key fails to pass authorization testing, the circuitry in the lock mechanism will refuse to operate the actuator installed and or refuse to pass sensor signals—depending on the selected design for the lock circuitry.

A delay before actuation of the lock, however, is undesirable. Accordingly, in a preferred design, an authorization bit is stored by the lock mechanism control circuitry within the lock and authorization testing is completed by the lock mechanism control circuitry after the lock completes an actuation cycle, not before.

The authorization bit is initially set to "authorized" status. The lock mechanism control circuitry checks the authorization bit before driving the actuator to operate the lock. This allows one or more initial cycles of the lock to be performed successfully, regardless of the true authorized status of the electrical connector key and provides the advantage of avoiding any delay for authorization testing. When the lock has a suitable time period to complete the authorization testing, the authorization bit is then set to "unauthorized" status and subsequent operation of the lock is prevented.

It will be understood that the electrical connector key may be adapted to provide many different types of configured interconnections between selected components within the electronic door lock and the external unit. One such configured interconnection is a simple "connected" or "not connected" configuration. The external unit may simply not be able to receive sensor signals (or not send signals to selected lock components.)

Another configuration may involve rerouting signals from the lock back to the lock for subsequent processing. One lock mechanism may be send "raw" sensor signals to the external unit. Another lock mechanism may have sophisticated electrical processing capabilities and may use the same "raw" sensor signal internally, in combination with other sensor signals to provide a processed output signal to the external unit.

Further, the electrical connector key may incorporate additional electronic components to provide additional functions to the lock. A WiFi transmitter/receiver and antenna may be added. Alternatively, the electrical connector key may be provided with a numbered ID chip allowing the lock to be identified by the external unit it is connected to. Many other interconnection schemes and additional functions for the electrical connector key will be apparent to those of skill in this art.

Another aspect of the invention resides in a system comprising multiple differently configured electrical connector keys of the type described above in combination with one or more different lock mechanisms capable of receiving a selected one of the differently configured electrical connector keys. Each different lock mechanism has a different selection of electrical components therein. The selected one of the differently configured electrical connector keys is paired with a selected one of the one or more different lock mechanisms.

The selected connector key and the selected one of the door lock mechanisms define a complete electronic lock ready for connection to the external unit and provides a specific selected interconnection between selected electrical components available in the selected one of the door lock mechanisms and circuitry in the external unit.

It will also be understood that another aspect of the invention is the method of providing an electronic door lock having desired functionality in which multiple differently configured electrical connector keys of the type described above are provided and one or more different door lock mechanisms capable of receiving the electrical connector keys are provided.

One of the provided one or more different door lock mechanisms is selected and one of the differently configured electrical connector keys is also selected. The combination of the selected electrical connector key and the selected door lock mechanisms provides the desired functions for the complete electronic door lock when the electrical connector key is inserted into the selected electronic door lock and connected to the external unit.

Therefore, the present invention achieves one or more of the objects described above. The configurable electrical connector key for connecting an electronic door lock to an external unit, such as a lock monitoring or control system, includes a connector key housing shaped to engage the electronic door lock and a configurable circuit mounted within the connector key housing that makes a configured interconnection between selected components within the door lock and the external unit. The combination of an electrical connector key and an electronic door lock and a system and method includes multiple differently configured electrical connector keys and one or more standardized electronic door locks to allow selected sensors and functions of the door lock to be enabled by selecting an appropriately configured electrical connector key.

While the invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An electrical connector key for electrically connecting selected components mounted within an electronic door lock to an external unit comprising:

a connector key housing shaped to engage the electronic door lock;

a lock side key connector mounted to the connector key housing for electrically connecting to the electronic door lock wherein:

the lock side key connector includes a plurality of electrical connection points, and the lock side key connector is shaped to electrically connect to a mating lock connector mounted within the electronic door lock when the connector key housing engages the electronic door lock;

a plurality of external electrical outputs for connection to the external unit; and a configurable circuit mounted within the connector key housing wherein:

the configurable circuit includes a plurality of electrical connections extending from a selected set of the electrical connection points on the lock side key connector to a selected set of the external electrical outputs, and the plurality of electrical connections of the configurable circuit and the selected sets of the electrical connection points and the external electrical outputs define a configured interconnection between the selected components within the electronic door lock and the external unit.

2. The electrical connector key according to claim 1 wherein the connector key housing is shaped to snap into a mating opening in the electronic door lock.

3. The electrical connector key according to claim 1 wherein the plurality of external electrical outputs for connection to the external unit comprise a plurality of wires and wherein selected wires are soldered at one end to the configurable circuit to define the selected set of the external electrical outputs.

4. The electrical connector key according to claim 1 wherein the electrical connector key communicates with the electronic door lock to identify the electrical connector key as an authorized electrical connector key.

5. The electrical connector key according to claim 2 wherein the plurality of external electrical outputs for connection to the external unit comprise a plurality of wires and wherein selected wires are soldered at one end to the configurable circuit to define the selected set of the external electrical outputs.

6. The electrical connector key according to claim 2 wherein the electrical connector key communicates with the electronic door lock to identify the electrical connector key as an authorized electrical connector key.

7. The electrical connector key according to claim 3 wherein the electrical connector key communicates with the electronic door lock to identify the electrical connector key as an authorized electrical connector key.

8. An electrical connector key in combination with an electronic door lock for connecting the electronic door lock to an external unit, wherein:

the electronic door lock includes a plurality of electrical components mounted therein and a lock connector for receiving the electrical connector key and connecting at least some of the plurality of electrical components to the electrical connector key; and the electrical connector key comprises:

a connector key housing shaped to engage the electronic door lock;

a lock side key connector mounted to the connector key housing for electrically connecting to the lock connector of the electronic door lock wherein:

the lock side key connector includes a plurality of electrical connection points, and the lock side key connector electrically connects and mates to the lock when the connector key housing engages the electronic door lock;

a plurality of external electrical outputs for connection to the external unit; and a configurable circuit mounted within the connector key housing wherein:

the configurable circuit includes a plurality of electrical connections extending from a selected set of the electrical connection points on the lock side key connector to a selected set of the external electrical outputs, and the plurality of electrical connections of the configurable circuit and the selected sets of the electrical connection points and the external electrical outputs define a configured interconnection between the selected components within the electronic door lock and the external unit.

9. The combination according to claim 8 wherein the connector key housing is shaped to snap into a mating opening in the electronic door lock.

10. The combination according to claim 8 wherein the plurality of external electrical outputs for connection to the external unit comprise a plurality of wires and wherein selected wires are soldered at one end to the configurable circuit to define the selected set of the external electrical outputs.

11. The combination according to claim 8 wherein the electrical connector key communicates with the electronic door lock to identify the electrical connector key as an authorized electrical connector key.

12. The combination according to claim 9 wherein the plurality of external electrical outputs for connection to the external unit comprise a plurality of wires and wherein selected wires are soldered at one end to the configurable circuit to define the selected set of the external electrical outputs.

13. The combination according to claim 9 wherein the electrical connector key communicates with the electronic door lock to identify the electrical connector key as an authorized electrical connector key.

14. The combination according to claim 10 wherein the electrical connector key communicates with the electronic door lock to identify the electrical connector key as an authorized electrical connector key.

15. An electronic door lock system comprising:

a plurality of differently configured electrical connector keys according to claim 1;

one or more different electronic door locks, each door lock being capable of receiving a selected one of the differently configured electrical connector keys.

16. A method of providing an electronic door lock providing desired lock functions for connection to an external unit, the method including the steps of:

providing a plurality of differently configured electrical connector keys according to claim 1;

providing one or more different electronic door locks, each door lock being capable of receiving a selected one of the differently configured electrical connector keys, at least one of the one or more different electronic door locks having electronic components for performing at least all of the desired lock functions;

selecting only one of the one or more different electronic door locks having electronic components for performing at least all of the desired lock functions;

selecting only one electrical connector key from among the plurality of differently configured electrical connector keys, the selected electrical connector key connecting to the electronic components of the selected door lock for performing the desired lock functions and connecting to the external unit to provide the desired lock functions.

17. The method according to claim 16 wherein the connector key housing is shaped to snap into a mating opening in the electronic door lock.

18. The method according to claim 16 wherein the plurality of external electrical outputs for connection to the external unit comprise a plurality of wires and wherein selected wires are soldered at one end to the configurable circuit to define the selected set of the external electrical outputs.

19. The method according to claim 16 wherein the electrical connector key communicates with the electronic door lock to identify the electrical connector key as an authorized electrical connector key.

20. The method according to claim 17 wherein the plurality of external electrical outputs for connection to the external unit comprise a plurality of wires and wherein selected wires are soldered at one end to the configurable circuit to define the selected set of the external electrical outputs.

21. The method according to claim 17 wherein the electrical connector key communicates with the electronic door lock to identify the electrical connector key as an authorized electrical connector key.

22. The method according to claim 18 wherein the electrical connector key communicates with the electronic door lock to identify the electrical connector key as an authorized electrical connector key.

* * * * *